United States Patent [19]

Mendenhall

[11] Patent Number: 4,519,511

[45] Date of Patent: May 28, 1985

[54] SHELF SUPPORTING BRACKET ARRANGEMENT

[76] Inventor: Walter M. Mendenhall, 512 Lillian Dr., Madeira Beach, Fla. 33708

[21] Appl. No.: 395,482

[22] Filed: Jul. 6, 1982

[51] Int. Cl.[3] ..... A47F 5/00

[52] U.S. Cl. ..... 211/187; 108/107; 211/191; 248/243

[58] Field of Search ..... 108/106, 107, 111, 144; 211/186, 187, 182, 190, 191, 193, 207, 208; 248/243

[56] References Cited

U.S. PATENT DOCUMENTS

| | | | |
|---|---|---|---|
| 2,566,622 | 9/1951 | Millier | 248/243 X |
| 2,947,390 | 8/1960 | Stollenwerk | 211/182 X |
| 3,080,980 | 3/1963 | Gibbons | 211/187 X |
| 3,519,140 | 7/1970 | Wellman | 211/182 X |

FOREIGN PATENT DOCUMENTS

| | | | |
|---|---|---|---|
| 1289272 | 2/1969 | Fed. Rep. of Germany | 248/243 |
| 365192 | 12/1962 | Switzerland | 248/243 |

*Primary Examiner*—Robert W. Gibson, Jr.

*Attorney, Agent, or Firm*—Maky, Renner, Otto & Boisselle

[57] ABSTRACT

A shelf support apparatus includes a pair of spaced apart longitudinally extending channel members facing each other and crosspieces which extend between the channel members and supports the shelf. Each channel member defines a guideway therein. The side of each channel member which faces the other channel member has two spaced apart front walls defining a slot between them. The slot extends along the length of the channel member. A plurality of support means are formed on each front wall of each channel member and extends into the guideway of the channel member. The support means are preferably longitudinally spaced along the channel members. Each crosspiece has relatively narrow portions extending through the slots in a pair of channel members and relatively wide support portions disposed within the guideways in the pair of channel members. Each end portion of the crosspiece is supported on support means extending into the guideways in the pair of channel members. The crosspieces, and therefore the shelf, can be readily repositioned along the channel members without removing the crosspieces from the guideways in the channel members.

8 Claims, 6 Drawing Figures

SHELF SUPPORTING BRACKET ARRANGEMENT

BACKGROUND AND SUMMARY OF THE INVENTION

This invention relates to a new and useful apparatus for supporting a shelf or the like. It relates particularly to a shelf support apparatus which can be manipulated into a variety of different shelf supporting arrangements, which provides strong and secure support for the shelves, and in a way which maintains an aesthetically pleasing appearance.

Shelving systems can be regularly found throughout retail stores and warehouses for supporting and displaying articles of merchandise. In the applicant's experience, it is important for such shelving systems to have certain characteristics which make them desirable for use in such establishments. Specifically, they should provide strong and secure support for the articles supported thereon. They should be easily adjustable for repositioning the shelves to accommodate different kinds and sizes of articles. They should also be of simple construction, and should present an aesthetically pleasing appearance.

The present invention provides a shelf support system, and components for such a shelf support system, which achieve the foregoing objectives. The components are relatively simple in construction, and are readily assemblable and adjustable into a variety of different shelf supporting arrangements. They provide a strong and secure support for display shelves, and in a way which produces a neat, efficient, and generally aesthetically pleasing appearance.

In accordance with a preferred form of the present invention, the shelf support system includes longitudinally extending pairs of channel members, and shelf-supporting crosspieces which extend between the pairs of channel members. The channel members have longitudinally extending guideways for receiving, supporting and guiding end portions of the crosspieces. The end portions of a crosspiece can be inserted into the respective guideways in a pair of channel members while the crosspiece is in a first orientation relative to the channel members. In that orientation, the crosspiece can move freely, in both longitudinal directions, in order to position it at a desired height in the channel members. The crosspiece can then turn, through about 90° to a second orientation in which its end portions can engage support members which are in the guideways, and which will support the crosspiece in a strong and secure manner. A crosspiece can be rotated back to its first orientation when it is desired to change the position of the crosspiece, or to remove the crosspiece from the channel members.

With the invention, the support structure for the crosspieces is mainly inside the channels. Thus, it is substantially hidden from view, and that enhances the aesthetic appearance of the shelf support system. Further, the fact that crosspieces which are not being used to support shelves can be readily removed from the channel members also enhances the aesthetic appearance of the shelf support system. Still further, the specific structure of the channel members is such that they could even be incorporated as integral parts of a building wall, if desired, rather than formed as separate members.

BRIEF DESCRIPTION OF THE DRAWINGS

Further features of the present invention will become further apparent from the following detailed description and the accompanying drawings wherein.

DESCRIPTION OF A SPECIFIC PREFERRED EMBODIMENT OF THE INVENTION

Figure 1:
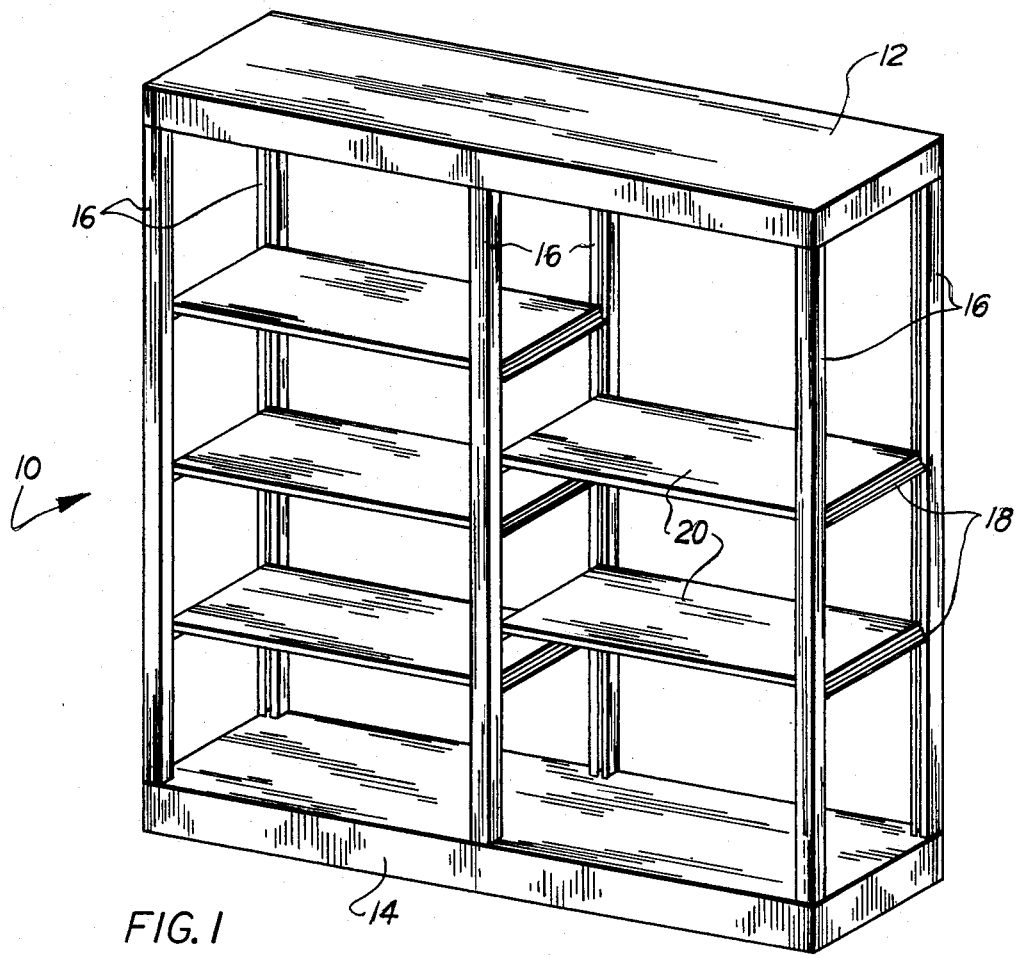
FIG. 1 is a pictorial view illustrating a shelf assembly incorporationg a shelf support apparatus constructed in accordance with the present invention.

FIG. 1 shows a shelf assembly 10 which is formed by the principles of the invention, and which supports a series of shelves 20 for items of merchandise. The shelf assembly 10 includes a top part 12, a base 14, and a plurality of longitudinally extending tubular channel members 16 extending vertically between the base 14 and the top part 12. Extending between, and supported by respective pairs of the channel members 16 are a series of crosspieces 18. The shelves 20 are supported on respective pairs of the crosspieces 18.

Each crosspiece 18 is associated with a pair of channel members 16. The crosspiece extends between a pair of channel members and has end portions 25 (FIG. 3) which extend into the pair of channel members 16 and are releasably supported within the pair of channel members 16. The end portions 25 of a crosspiece 18 can be released from the channel members 16, in order to change position of the crosspiece in the shelf assembly 10, or to remove the crosspiece from the shelf assembly 10.

Each crosspiece 18 is a longitudinally extending member with a center portion 24 and a pair of end portions 25. The center portion 24 comprises a relatively wide, planar body 27 and spaced apart ribs 48 extending perpendicular to the planar body 27. The end portions 25 are planar, preferably coplanar with the planar body 27, and include (i) relatively narrow neck portions 26 which extend through longitudinal slots 22 in a pair of channel members 16 and (ii) relatively wide support portions 28 which are supported within the pair of channel members 16. Spaced apart ribs 48 extend upward from the planar body 27 of the crosspieces 18 when the crosspieces are supported in the channel members 16, and serve to laterally align and support a shelf 20 on the crosspiece 18.

Figure 2:
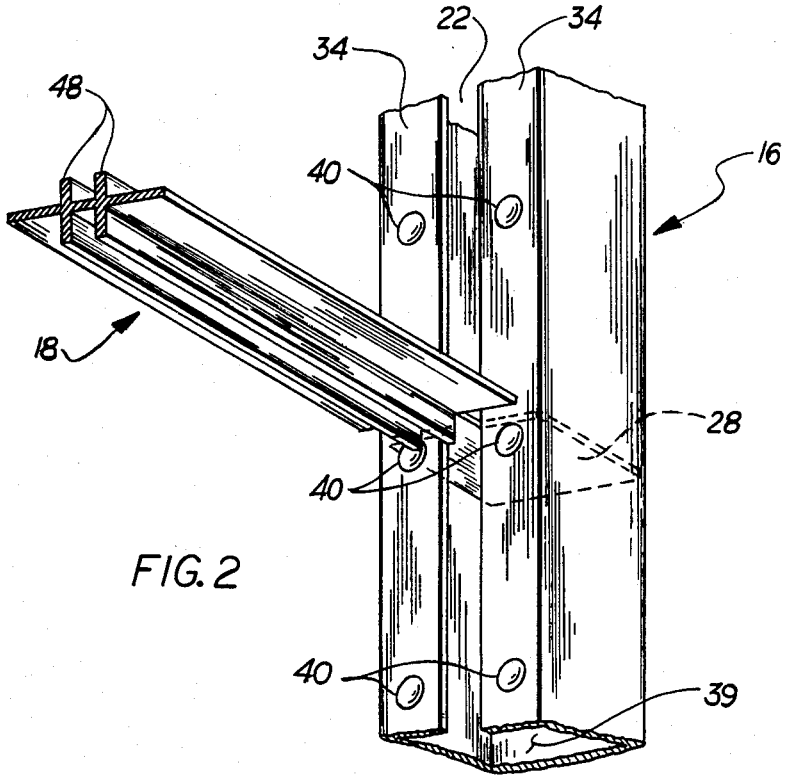
FIG. 2 is a fragmentary perspective view of part of a shelf support apparatus constructed in accordance with the present invention, illustrating the relationship between a support channel member and a crosspiece supported therein.
Figure 3:
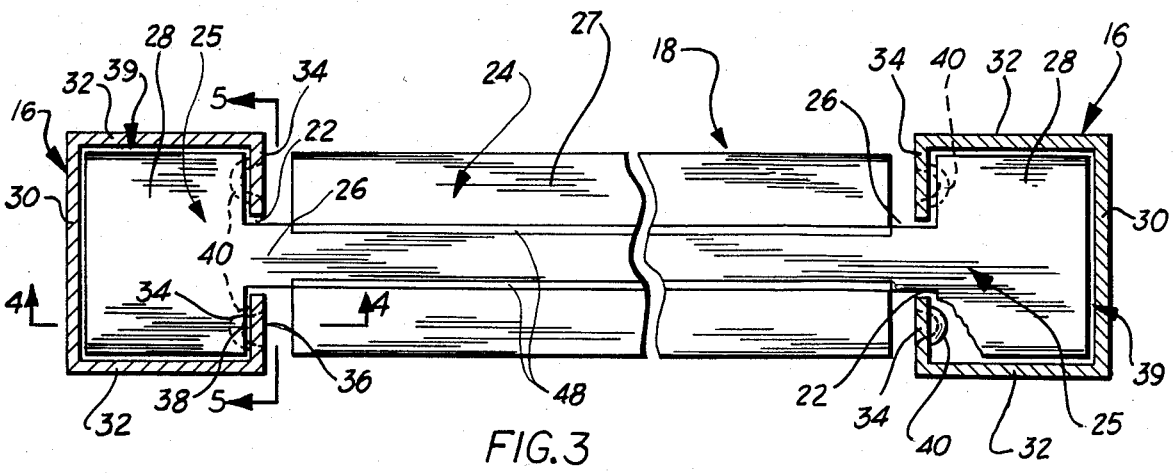
FIG. 3 is a view illustrating a crosspiece in top plan view and its two associated support channel members in sectional view, when the crosspiece is being supported by the channel members.

Each channel member 16 is preferably a longitudinally extending, generally box-shaped tubular member (see particularly FIGS. 2 and 3). Each channel member 16 includes a back wall 30, a pair of parallel side walls 32, and a pair of coplanar front walls 34. On each channel member 16, the coplanar front walls 34 are spaced apart from each other and define the longitudinally extending slot 22 in the channel member. Each front wall 34 has an outside surface 36 and an inside surface 38. The front walls 34 of each pair of channel members 16 which support a crosspiece are parallel to each other, and have outside surfaces 36 which face each other (see FIG. 3). Thus, the longitidinal slots 22 in each pair of channel members 16 which support a crosspiece 18 are in facing relation with each other.

On each channel member 16, the back wall 30 and the side walls 32 have inside surfaces which, together with the inside surfaces 38 of the front walls 34 define a longitudinally extending guideway 39 within the channel member 16. When a crosspiece is connected with a pair of channel members, the relatively narrow necks 26 of the end portions 25 of the crosspiece 18 extend through the facing slots 22 in the pair of channel members 16, and the relatively wide portions 28 of the crosspiece are disposed in the guideways 39 of the pair of channel members.

Support means are provided at longitudinally spaced locations within the guideways 39 of each channel member 16 for releasably supporting the end portion of a crosspiece 18 therein. In each channel member 16 the support means preferably comprises pairs of support members 40 which extend into the guideway 39 in the channel member from the inside surfaces 38 of the front walls 34. The support members 40, as shown, are integrally formed with the fronts walls 34 of the channel member. When the channel members 16 are formed of metal, the support members 40 can be stamped out of the front walls 34. It is also contemplated that other types of support means can be used, such as pins or screws sticking through the front walls 34 and into the channel member 16.

When a crosspiece 18 is supported by a pair of channel members 16, the relatively wide portions 28 at the ends of the crosspiece 18 rest on respective support members 40 in the pair of channel members. In that orientation, the crosspiece 18 cannot be removed from the channel members and the support members 40 provide strong and secure support for the crosspiece. The support members 40 are longitudinally spaced along the channel members 16 so that the respective support members 40 which support both end portions of each should be at the same height from floor level. Thus, the crosspieces 18 and the shelves 20 will be level.

A crosspiece 18 is readily releasable from a pair of channel members 16 for changing the height of the crosspiece, or for removing the crosspiece from a pair of channel members 16. The relatively wide portion 28 of the crosspiece 18 has a geometry which is similar to the geometry of the guideways 39 in the channel members. Thus, it can be lifted off a pair of support members 40 to release it from the support members. Once released from the support members 40 in a pair of channel members 16, the crosspiece can be turned through a 90° angle to an orientation in which it can move freely into and out of the pair of channel members, and can also move freely in both longitudinal directions in the channel members in order to change the position of the crosspiece.

Figure 5:
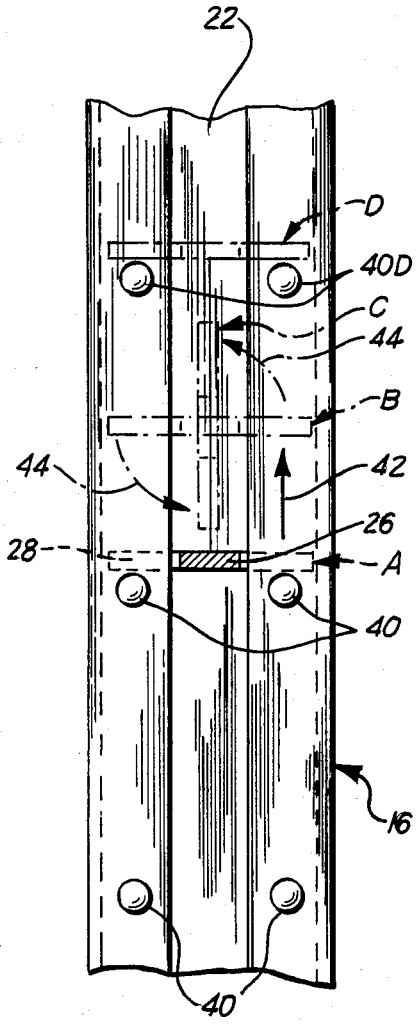
FIG. 5 is a sectional view taken generally along lines 5—5 of FIG. 3 and schematically illustrating in phantom the movement of one end of a crosspiece within a support channel member in changing the position of the crosspiece in the support channel member.
Figure 4:
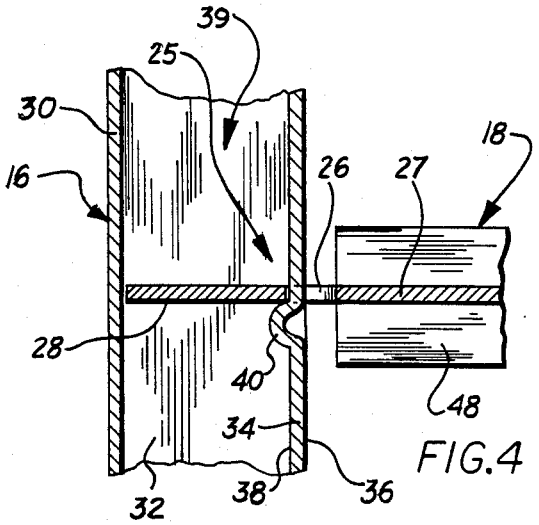
FIG. 4 is a sectional view taken along lines 4—4 of FIG. 3.

FIG. 5 schematically illustrates how the position of a crosspiece 18 in a channel member is changed. The crosspiece is shown at A in a first orientation in which one of its relatively wide portions 28 rests on a pair of support members 40 in a channel member 16. The crosspiece 18 can be released from the support members 40, by lifting the crosspiece 18, in the direction indicated by arrow 42, to bring its relatively wide portions 28 to the position indicated in phantom at B. The crosspiece 18 can then be turned through about 90° (see arrows 44) while its wide portions 28 are still inside the channel members 16, to bring it to a second orientation indicated in phantom at C. When it is in the orientation shown at C, relatively wide portions 28 of the crosspiece will be clear of the support members 40, and the crosspiece will be able to move freely in both longitudinal directions. Thus, to change its position the crosspiece 18 can then be moved in a desired direction, e.g. upward, in the direction of arrow 42, to a position above the next set of elongated support members 40D. The crosspiece 18 is then turned back through 90° to the first orientation A and rested on the elongated members 40D, as indicated at D.

As can be seen from the foregoing description, in order to change the position of a crosspiece 18, the crosspiece 18 is lifted, turned through 90°, repositioned, turned back through 90°, and placed in the newly desired position. The relatively wide support portions 28 of the crosspiece 18 remain in the guideways 39 of the channel members 16 while the crosspiece's position is changed. Thus, repositioning the crosspieces 18 in the channel members is an efficient operation.

Figure 6:
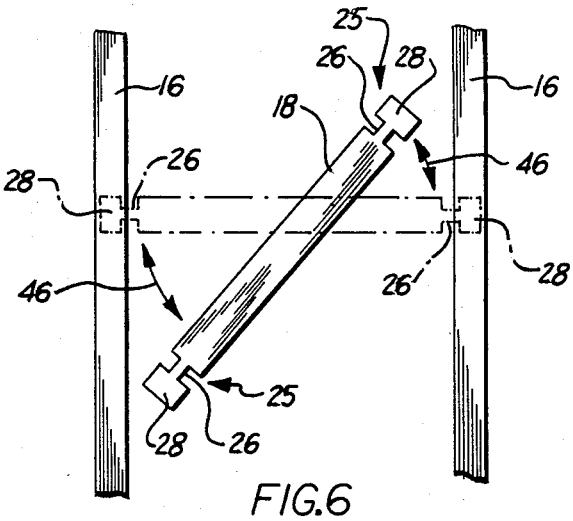
FIG. 6 is a schematic view illustrating the insertion or removal of a crosspiece from a pair of support channel members.

The crosspieces 18 are also easily inserted into and removed from a pair of channel members 16. To insert a crosspiece 18 between a pair of vertically extending channel members 16, the crosspiece is first positioned as shown in solid lines in FIG. 6, at an angle to the horizontal. The crosspiece 18 is turned about its longitudinal axis (i.e. to the orientation shown at C in FIG. 5) so that its end portions 25 can move through the slots 22 and into the channel members 16. The crosspiece 18 is then pivoted, in the direction of arrows 46, into the position shown in phantom in FIG. 6, with the relatively wide support portions 28 within the channel members 16 and the relatively narrow neck portions 26 disposed in the slots 22. The crosspiece 18 is then shifted longitudinally until it is aligned with the desired support members 40, and is turned about its longitudinal axis and rested upon a pair of support members 40 in each channel member 16. In order to remove the crosspiece 18 from a pair of channel members 16, the above-described insertion process is simply reversed.

The shelf support apparatus of the present invention will securely support a shelf, and yet presents an aesthetically pleasing appearance since the support members 40 which support the crosspieces 18 are within the channel members 16 and thereby hidden from view. Moreover, the channel members 16 can even be incorporated in a building wall, which can further enhance the aestethic appearance of the shelf system.

The crosspieces 18, which may be made out of plastic or metal, preferably include the planar body 27, on which a shelf 10 can rest and the upstanding ribs 48 (FIGS. 2 and 3) which resist lateral shifting of a shelf. More specifically, if a shelf has depending rims at its ends, the upstanding ribs 48 define channels which can receive the depending rims to secure the shelves against lateral shifting. Where the shelves do not have depending rims, the upstanding ribs 48 still define stop surfaces which prevent lateral shifting of the shelves.

From the foregoing description, it is apparent that the shelf support apparatus of the present invention provides crosspieces 18 which provide strong, secure, yet easily releasable support for shelves 20. The shelves 20 are readily repositioned by the simple operation of moving the crosspieces 18 within the guideways 39 in the channel members 16. The shelf support apparatus of the present invention is simple, easy to manufacture, and easy to assemble, and presents an aesthetically pleasing appearance.

What is claimed is:

1. Apparatus for use in supporting a shelf or the like, comprising a pair of spaced apart longitudinally extending channel members having respective longitudinally extending slots disposed in facing relation with each other, a crosspiece extending between said pair of channel members, said crosspiece having integral end portions which extend through the facing slots and into said channel members, and a plurality of support means longitudinally spaced within each of said channel members for engaging and supporting the end portions of said crosspiece within the channel member to support the end portions of the crosspiece when the crosspiece is in a first orientation relative to the channel members, the crosspiece being turnable to a second orientation relative to the pair of channel members while its end portions are disposed within said pair of channel members, the end portions of the crosspiece being released from engagement with the support means in the pair of channel members when the crosspiece is in said second orientation, the end portions of the crosspiece being longitudinally movable in the pair of channel members while the crosspiece is in its second orientation to change the position of the crosspiece relative to the pair of channel members, each of said pair of channel members defining a longitudinally extending guideway, the support means in each channel member projecting into the guideway for engaging and supporting an end portion of a crosspiece disposed therein when the crosspiece is in said first orientation, the end portions of a crosspiece which extends within a guideway in a channel being dimensioned to (i) slide in both longitudinal directions in the guideway when the crosspice is in its second orientation, (ii) turn in the guideway as the crosspiece turns between its first and second orientations, and (iii) rest on a support means in the guideway when the crosspiece is in its first orientation, each of the facing slots in the channel member having a predetermined width, and the guideway in each channel member having a predetermined width which is greater than the width of the slot in the respective channel member, each of the end portions of the crosspiece including a relatively narrow neck portion which has a width which is less than the predetermined width of the slots in the channel members and a relatively wide support portion which has a width which is greater than the predetermined width of the slots in the channel members, and the support means in each channel member projecting into the guideway in the channel member at a location outside the width of the slot associated with that channel, the end portions of the crosspiece and the guideways in the channel members being dimensioned to allow relatively unobstructed longitudinal movement of an end portion of a crosspiece in the guideway in a channel member when the crosspiece is in its second orientation, each channel member including first and second coplanar front walls which are spaced apart from each other and define the longitudinal slot in the channel member, and each support means in the channel member comprising at least one support member projecting into the guideway in the channel member from at least one of said first and second front walls in the channel member.

2. Apparatus as set forth in claim 1 wherein each support member is integral with a front wall in its respective channel member and projects into the guideway from the front wall.

3. Apparatus as set forth in claim 2 wherein the crosspiece further includes means for resisting lateral shifting of a shelf supported on the crosspiece.

4. Apparatus as set forth in claim 3 wherein the crosspiece comprises a generally planar main body member having a relatively wide center section, and said relatively narrow neck portions and relatively wide support portions of the end portions of the crosspiece are planar members which are co-planar with said planar main body member, said means for resisting lateral shifting of a shelf on the crosspiece comprising stop means extending out of the plane of said main body member.

5. Apparatus as set forth in claim 4 wherein each of said channel members comprises an elongated generally box-shaped member including a back wall, a pair of spaced apart generally parallel side walls connected by said back wall and first and first second generally coplanar front walls, each of said first and second front walls being integral with a respective one of said first and second side walls, said first and second front walls being generally parallel to said back wall and being spaced apart from each other to define said longitudinally extending slot.

6. Apparatus for use in supporting a shelf or the like, comprising a pair of spaced apart longitudinally extending guides and a crosspiece extending between said guides, each of said pair of guides including first and second coplanar longitudinally extending walls spaced apart from each other and defining a longitudinally extending slot therebetween, the plane of the first and second walls of one of said spaced apart pair of guides being parallel to the plane of the first and second walls of the other of said pair of spaced apart guides, the slot defined by first and second walls of one of said pair of spaced apart guides being in facing relation with the slot defined by the first and second walls of the other of said pair of spaced apart guides, support means associated with said first and second walls of each of said pair of spaced apart guides, said support means projecting out of the plane of the first and second walls of a respective one of said pair of spaced apart guides and in a direction away from the other of said pair of spaced apart guides, and said crosspiece having end portions which extend through the slots in each of said pair of spaced apart guides for engaging the support means associated with each of said pair of spaced apart guides, said crosspiece being longitudinally movable relative to said pair of spaced apart guides while its end portions extend through the slots in said pair of spaced apart guides, for changing the position of said crosspiece in said spaced apart guides without removing the crosspiece from said pair of spaced apart guides.

7. Apparatus as set forth in claim 6 wherein each of said end portions of said crosspiece includes a relatively narrow neck portion which has a width which is less than the width of a slot defined in one of said spaced apart guides and a relatively wide support portion which has a width which is greater than the width of the slot defined in the one of the spaced apart guides, the relatively narrow neck portion of a crosspiece being dimensioned so that it can turn in the slot and shift longitudinally relative to said pair of spaced apart guides, and each of the relatively wide portions of the crosspiece being dimensioned so that when it is in one orientation relative to the first and second walls of one of said pair of spaced apart guides it is supported by the support means associated with the guide and it can turn to another orientation in which it is not supported by the support means associated with the guide and can move freely in both longitudinal directions relative to the guide.

8. Apparatus as set forth in claim 7 wherein the support means associated with each of said pair of spaced apart guides comprises a first member projecting from the first wall of the guide and a second member projecting from the second wall of the guide.

* * * * *